US007094050B2

(12) United States Patent
Inomata

(10) Patent No.: US 7,094,050 B2
(45) Date of Patent: Aug. 22, 2006

(54) BURNER

(75) Inventor: Masanobu Inomata, Nagoya (JP)

(73) Assignee: Rinnai Corporation, Aichi (JP)

( * ) Notice: Subject to any disclaimer, the term of this patent is extended or adjusted under 35 U.S.C. 154(b) by 87 days.

(21) Appl. No.: 10/864,440

(22) Filed: Jun. 10, 2004

(65) Prior Publication Data

US 2004/0224273 A1 Nov. 11, 2004

(51) Int. Cl.
*F23D 14/62* (2006.01)
*F23D 14/58* (2006.01)

(52) U.S. Cl. ..... 431/354; 431/349

(58) Field of Classification Search ..... 431/354, 431/349, 168, 172, 278, 286; 126/39 E, 126/39 R; 239/555, 558
See application file for complete search history.

(56) References Cited

U.S. PATENT DOCUMENTS

| | | | | |
|---|---|---|---|---|
| 3,729,876 | A * | 5/1973 | Kolozsvary | 52/81.4 |
| 3,744,340 | A * | 7/1973 | Peterson | 74/560 |
| 4,572,237 | A * | 2/1986 | Thompson | 137/487.5 |
| 5,135,193 | A * | 8/1992 | Parris | 248/238 |
| 6,151,215 | A * | 11/2000 | Hoffman | 361/704 |

FOREIGN PATENT DOCUMENTS

| | | | |
|---|---|---|---|
| GB | 967124 | A | 8/1964 |
| JP | 2-133515 | U | 11/1990 |
| JP | 3-14531 | U | 2/1991 |
| JP | 3-46104 | U | 4/1991 |
| JP | 4-353308 | A | 12/1992 |
| JP | 9-4853 | A | 1/1997 |
| WO | WO-02/02991 | A1 | 1/2002 |
| WO | WO-03/078896 | A1 | 9/2003 |

* cited by examiner

*Primary Examiner*—Alfred Basichas
(74) *Attorney, Agent, or Firm*—Birch, Stewart, Kolasch & Birch, LLP

(57) ABSTRACT

A burner capable of reducing manufacturing costs by attaching upper and lower flow regulating plates to a metal plate rationally from the viewpoint of costs is provided. A burner 100 comprises a metal plate, having formed thereto a plurality of flame ports 102 disposed along the inner circumference of an opening 101 and alternately protruding in the upper and lower directions, and an annular mixture pipe 106 disposed outwardly of the opening 101. Substantially annular upper and lower flow regulating plates 200 and 300 are respectively disposed above and below the burner 100 with a clearance therebetween. The burner 100 has an integrally disposed flange portion 120 extending outwardly from the annular mixture pipe 106. The upper and lower flow regulating plates 200 and 300 have integrally disposed arms 220 and 320 that extend from outer circumferences of the upper and lower flow regulating plates 200 and 300 across the annular mixture pipe to a position corresponding to the flange portion and crimped to the flange portion.

12 Claims, 6 Drawing Sheets

PRIOR ART

BURNER

BACKGROUND OF THE INVENTION

1. Field of the Invention

The present invention relates to a burner.

2. Description of the Related Art

A burner 530 according to the prior art illustrated in FIG. 6 is composed of a metal plate, having an upper flow regulating plate 510 and a lower flow regulating plate 550 disposed above and below the burner 530 via upper fixing members 520 and lower fixing members 540.

The upper fixing member 520 comprises a substantially rectangular upper plate portion 524 having a screw hole 522, substantially rectangular side plate portions 526 extending downward from both sides of the upper plate portion 524, and lower plate portions 528 respectively extending in opposite directions from the lower end of the side plate portions 526. The upper flow regulating plate 510 is provided with through holes 512 formed to the position corresponding to the screw holes 522 of the upper fixing members 520.

The lower fixing member 540 is substantially horseshoe-shaped, with screw holes 542 provided to both ends thereof. The lower flow regulating plate 550 is provided with through holes 552 formed to positions corresponding to the screw holes 542 of the lower fixing members 540.

The lower plate portions 528 of the upper fixing member 520 are spot-welded to the upper surface of the burner 530 (refer to x marks of FIG. 6). Thereafter, the upper flow regulating plate 510 is fixed to the upper fixing members 520 by having screws 514 secured via the through holes 512 to the screw holes 522 of the upper fixing members 520.

Further, the lower fixing members 540 are spot-welded to the lower surface of the burner 530 (refer to x marks of FIG. 6). Thereafter, the lower flow regulating plate 550 is fixed to the lower fixing members 540 by having screws 554 secured via the through holes 552 to the screw holes 542 of the lower fixing members 540.

SUMMARY OF THE INVENTION

According to the burner of the prior art, the upper fixing members 520 and the lower fixing members 540 must be manufactured and managed separately from the upper flow regulating plate 510 and the lower flow regulating plate 550, and they must be spot-welded to the burner 530. These processes hinder the reduction of manufacture costs of the burner 530.

It is possible to integrally form the upper flow regulating plate 510 with the upper fixing members 520 and to spot-weld the same, for the purpose of reducing the number of components. However, if the upper fixing member 520 is coated with porcelain enamel or the like for the purpose of improving durability and appearance, it is not possible to perform spot welding. Therefore, when coating porcelain enamel to the upper flow regulating plate 510 having the upper fixing members 520 formed integrally thereto, the porcelain enamel coating must be applied to the surface excluding the areas to be subjected to spot welding.

Typically, however, the method for coating porcelain enamel involves immersing the whole body of the object to a bath containing porcelain enamel in order to apply the porcelain enamel to the surface of the object, and baking the applied porcelain enamel onto the surface of the object. Accordingly, a separate facility must be prepared to apply the porcelain enamel to the surface excluding the areas to be subjected to spot welding, which increases costs than separately manufacturing the upper fixing members 520.

For these reasons, the upper flow regulating plate 510 and the lower flow regulating plate 550 are attached to the burner 530 according to the above-described method illustrated in FIG. 6. The burner 530 is formed by pressing a metal plate, and oil is applied to carry out the pressing process smoothly, but the upper fixing members 520 or the like cannot be spot-welded to the burner with oil attached thereto. Thus, a process for washing the burner 530 and removing the attached oil is required, but the used washing liquid is an environmentally-unfavorable waste, and the processing costs thereof is expensive.

Thus, the object of the present invention is to provide a burner with reduced manufacturing costs, by attaching the upper and lower flow regulating plates to the metal plate in a rational manner from the viewpoint of costs.

The present invention relates to a burner comprising a metal plate with a round opening, having formed thereto a plurality of flame ports arranged along an inner circumference of the opening and an annular mixture pipe disposed outwardly of the opening for supplying a mixture of gas and primary air to the flame ports, and substantially annular upper and lower flow regulating plates respectively disposed above and below the metal plate with a clearance therebetween for regulating flow of secondary air.

The burner according to the present invention for solving the above-mentioned problems comprises a flange portion formed integrally thereto and projecting outwardly of the annular mixture pipe, and arms formed integrally to the upper and lower flow regulating plates, extending from outer circumferences of the upper and lower flow regulating plates across the annular mixture pipe to a position corresponding to the flange portion and fixed mechanically to the flange portion.

According to the preset invention, the flange portion is integrally disposed to the burner, so the number of components is not increased thereby. Moreover, since the upper and lower flow regulating plates are fixed to the flange portion through arms integrally formed thereto, the number of components is reduced compared to the case where the plates are fixed to the burner via separate fixing members. Therefore, the management costs and the like of the upper and lower flow regulating plates can be cut down.

Furthermore, the arms are fixed mechanically to the flange portion. Here, what is meant by "fixed mechanically" is that the arms are fixed not via heating, voltage application, adhesives and so on, but via various mechanical methods such as crimping, fitting, meshing, engaging and so on. Therefore, when applying coating material such as porcelain enamel to the upper and lower flow regulating plates, there is no need to exclude the arms when immersing the plates in a bath containing coating material, and the entire body of the flow regulating plates including the arms can be immersed in coating material using existing facilities.

Moreover, since the upper and lower flow regulating plates are fixed mechanically to the burner, the metal plate constituting the burner can be coated with a coating material for facilitating processing, which was not possible when plates were attached via spot welding. By applying a coating for facilitating processing, the metal plate constituting the burner can be press-molded smoothly without having to use oil, and the washing process to remove oil from the metal plate can be omitted.

According to the present invention, (1) the reduction of the number of components, (2) the easiness of applying coating material to upper and lower flow regulating plates and (3) the omission of oil washing process of the metal plate enable the upper and lower flow regulating plates to be attached to the burner rationally from the viewpoint of costs, and thus, the manufacture cost of the burner can be reduced.

Further, the burner according to the present invention characterizes in that the arms of the upper and lower flow regulating plates are mechanically fixed to the flange portion at the same position.

According to the present invention, the area of the flange portion can be reduced and the burner body can be downsized compared to the case where the arms of the upper and lower flow regulating plates are fixed mechanically to the flange portion at different positions.

Furthermore, the burner according to the present invention characterizes in comprising a fixing means for mechanically fixing the arms of both the upper and lower flow regulating plates together to the flange portion.

According to the present invention, the upper and lower flow regulating plates can be fixed efficiently and promptly to the burner compared to the case where the arms of the upper and lower flow regulating plates are separately fixed mechanically to the flange portion.

Moreover, the burner according to the present invention characterizes in comprising contact sections disposed along a circumferential direction of the flow regulating plates for restricting tilt of the flow regulating plates by coming into contact with the burner when the arms of the upper and lower flow regulating plates are mechanically fixed to the flange portion.

Since the upper and lower flow regulating plates are respectively disposed above and below the burner with a clearance therebetween, the plates may be slanted in the space of the clearance during fixing. According to the present invention, the contact sections prevent the upper and lower flow regulating plates from being tilted with respect to the burner when being fixed mechanically to the flange portion. Thus, the present invention avoids inappropriate flow regulation of secondary air for combustion of the burner.

Further, the burner according to the present invention characterizes in that the flange portion is provided with a slit, the arm of the lower flow regulating plate is extended across the annular mixture pipe to reach the slit on the flange portion, and the arm of the upper flow regulating plate comprises an upper plate portion extending in the outer radial direction from the substantially annular upper flow regulating plate, a side plate portion extending downward from both left and right ends of the upper plate portion, a lower plate portion extending transversely from the lower end of the side plate portion in contact with the flange portion, and a claw portion extending from the end of the lower plate portion through the slit and protruding below the flange portion, which is bent to embrace the arm of the lower flow regulating plate and to be crimped to the flange portion.

Furthermore, the burner according to the present invention characterizes in that the flange portion is provided with a through hole, the arm of the upper flow regulating plate comprises an upper plate portion extending in the outer radial direction from the substantially annular upper flow regulating plate, a side plate portion extending downward from both left and right ends of the upper plate portion, and a lower plate portion extending transversely from the lower end of the side plate portion in contact with the flange portion and having formed thereto a first screw hole corresponding to the through hole of the flange portion, the arm of the lower flow regulating plate comprises a second screw hole corresponding to the through hole of the flange portion, and the arm of the upper flow regulating plate, the flange portion and the lower flow regulating plate are screwed together via the first screw hole, the through hole and the second screw hole.

DETAILED DESCRIPTION OF THE PREFERRED EMBODIMENTS

Now, the preferred embodiments of the burner according to the present invention will be explained with reference to the drawings.

Figure 1:
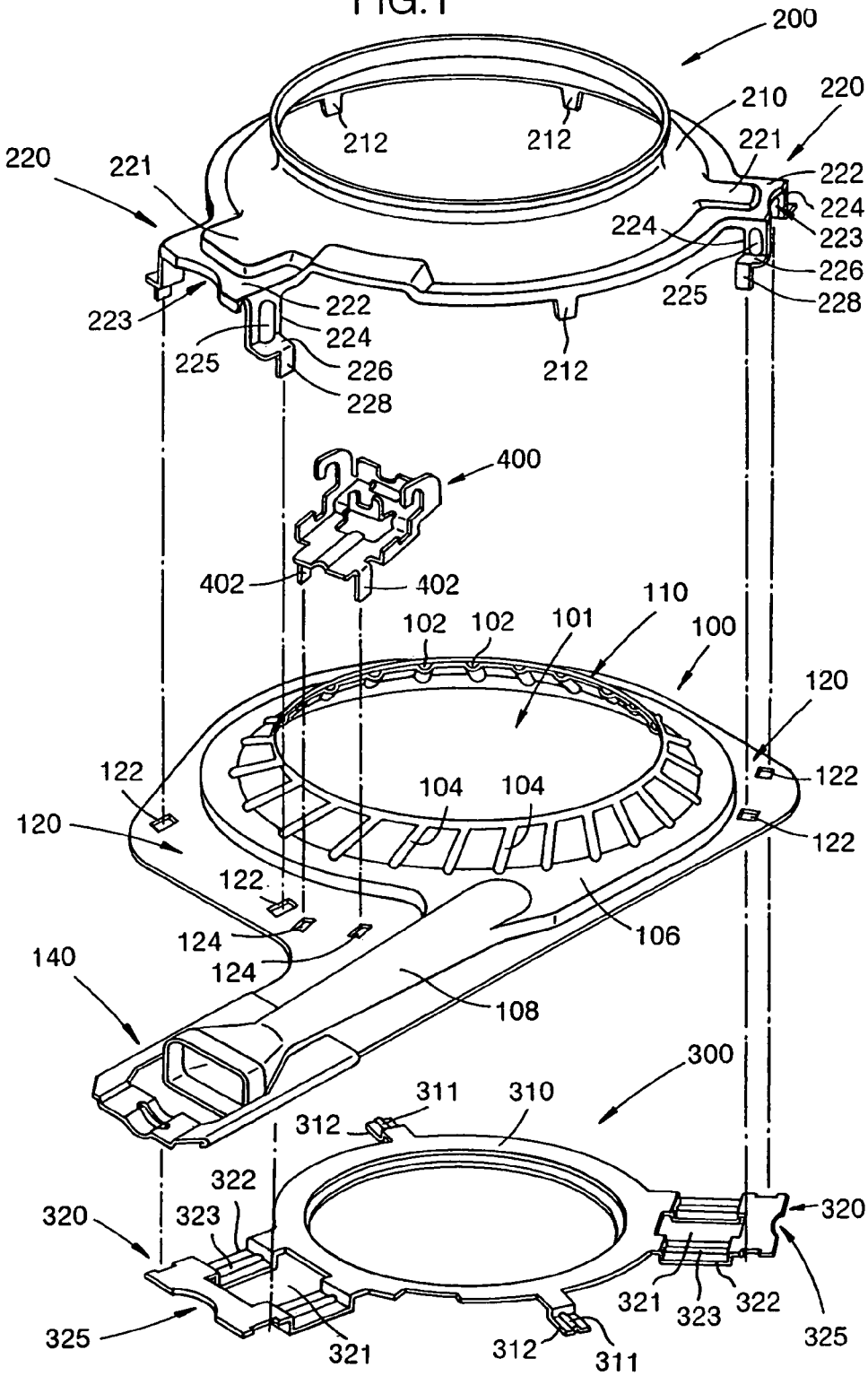
FIG. 1 is an explanatory view showing the structure of a burner according to a first preferred embodiment of the present invention.

A burner 100 shown in FIG. 1 is formed of two substantially q-shaped metal plates, one plate superposed on the other plate, and the plates are crimped at the periphery portion thereof. The metal plates constituting the burner 100 are coated with a coating material such as acrylic resin for facilitating processing. The coating for facilitating processing enables the metal plates constituting the burner 100 to be press-molded smoothly.

The burner 100 comprises a circular opening 101, a truncated cone portion 110 that gradually increases in diameter from the opening 101 toward the lower direction, an annular mixture pipe 106 disposed at the outer circumference of the truncated cone portion 110, and a linear mixture pipe 108 communicated substantially tangential to the annular mixture pipe 106.

The burner 100 further comprises a plurality of flame ports 102 disposed along the circumferential direction of the opening 101 and alternately protruding in the upper and lower directions, and linear gas channels 104, each channel starting at one flame port 102 and extending diagonally downward along the truncated cone portion 110 so as to communicate with the annular mixture pipe 106. The two metal plates constituting the burner 100 each has a periodic waveform of substantially constant amplitude formed along the circumferential direction at the periphery of the opening thereof, and one metal plate is superposed on the other with the phase of the waveform displaced by p/2, by which the gas channels 104 are formed.

Figure 2:
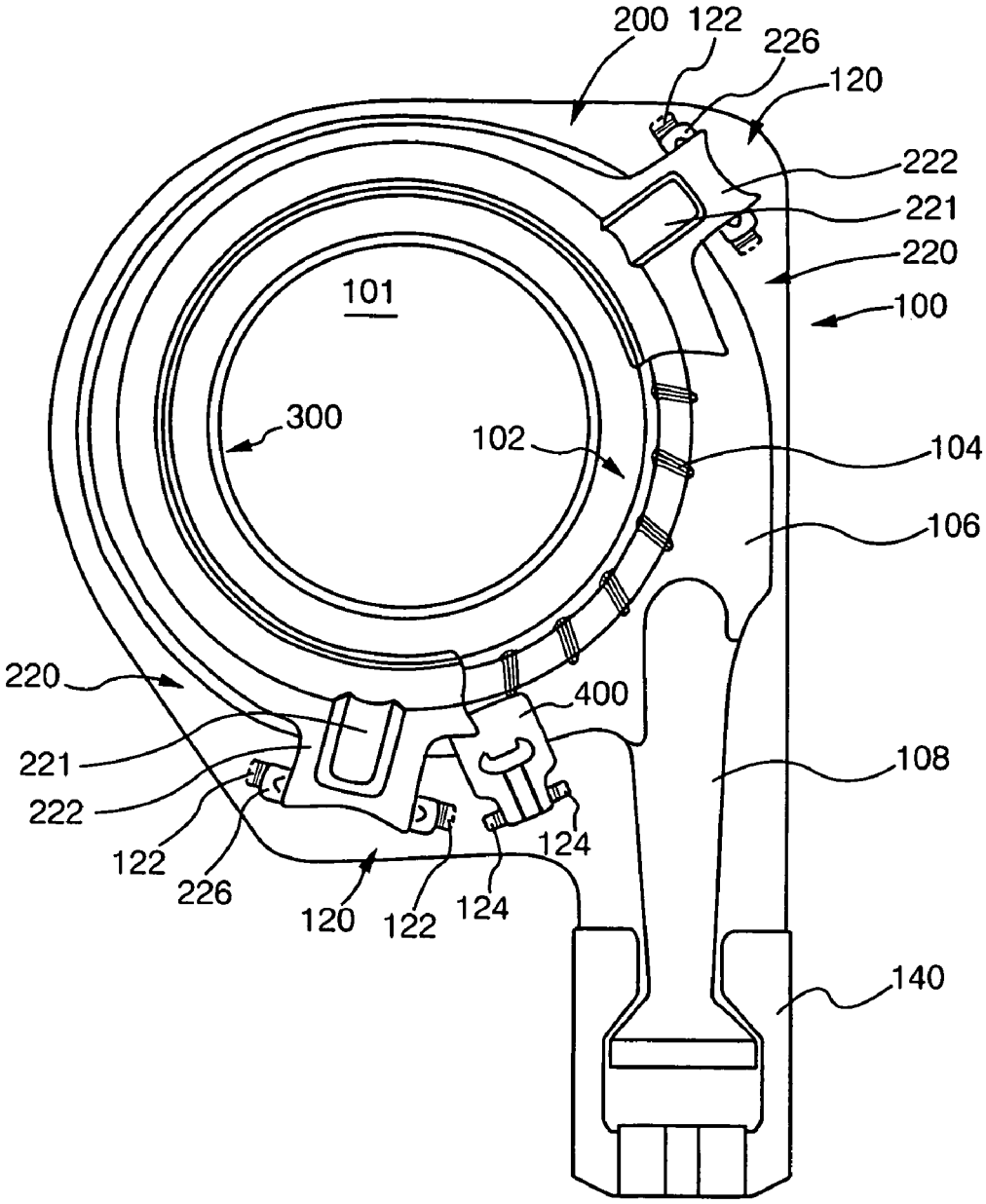
FIG. 2 is a top view of the burner according to the first preferred embodiment of the present invention.

Further, the burner 100 has an integrally formed flange portion 120 projecting outwardly of the annular mixture pipe 106, as shown in FIG. 2. The flange portion 120 illustrated at the upper right side of FIG. 2 has a substantially boomerang-like shape, with a pair of slits 122 formed at substantially equal distance from the center of the opening. The flange portion illustrated at the lower side of FIG. 2 is substantially trapezoidal, with two pairs of slits 122 and 124 formed at substantially equal distances from the center of the opening 101.

At the end of the linear mixture pipe 108, a substantially U-shaped support plate 140 for supporting a gas pipe (not shown) communicating with the linear mixture pipe 108 is crimped from the outside to the overlap space of the two metal plates constituting the burner 100.

The burner 100 is equipped with an upper flow regulating plate 200 and a lower flow regulating plate 300 disposed above and below the burner for regulating the flow of secondary air. Both flow regulating plates 200 and 300 have coating material such as porcelain enamel coating the whole surface thereof to improve durability and appearance.

Similar to the burner 100, the upper flow regulating plate 200 comprises an opening, and a truncated cone portion 210 that gradually increases in diameter from the opening toward the lower direction. Further, the upper flow regulating plate 200 has two arms 220 extending from the lower end of the truncated cone portion 210 respectively toward the upper right direction and lower direction of FIG. 2.

Each arm 220 comprises an upper plate portion 222 that extends from the lower end of the truncated cone portion 210 in the outer radial direction to the area above the flange portion 120, side plate portions 224 that extend downward from both left and right sides of the upper plate portion 222, lower plate portions 226 extending from the lower ends of the side plate portions 224 laterally while coming in contact with the flange portion 120, and claw portions ("fixing means" of the present invention) 228 extending downward from the end of the lower plate portions 226 and projecting below the flange portion 120 via slits 122. The base of the upper plate portion 222 is provided with a rib 221 that is raised substantially in a rectangular shape. A recess 223 is formed to the tip of the upper plate portion 222, with the center of the recess retired toward the inner circumferential direction. Each side plate portion 224 has a rib 225 raised outwardly and extending vertically.

Further, as shown in FIG. 1, the upper flow regulating plate 200 is equipped with three contact sections 212 that are circumferentially spaced apart at the lower end of the truncated cone portion 210 and protruding downward to the same height.

Figure 3:
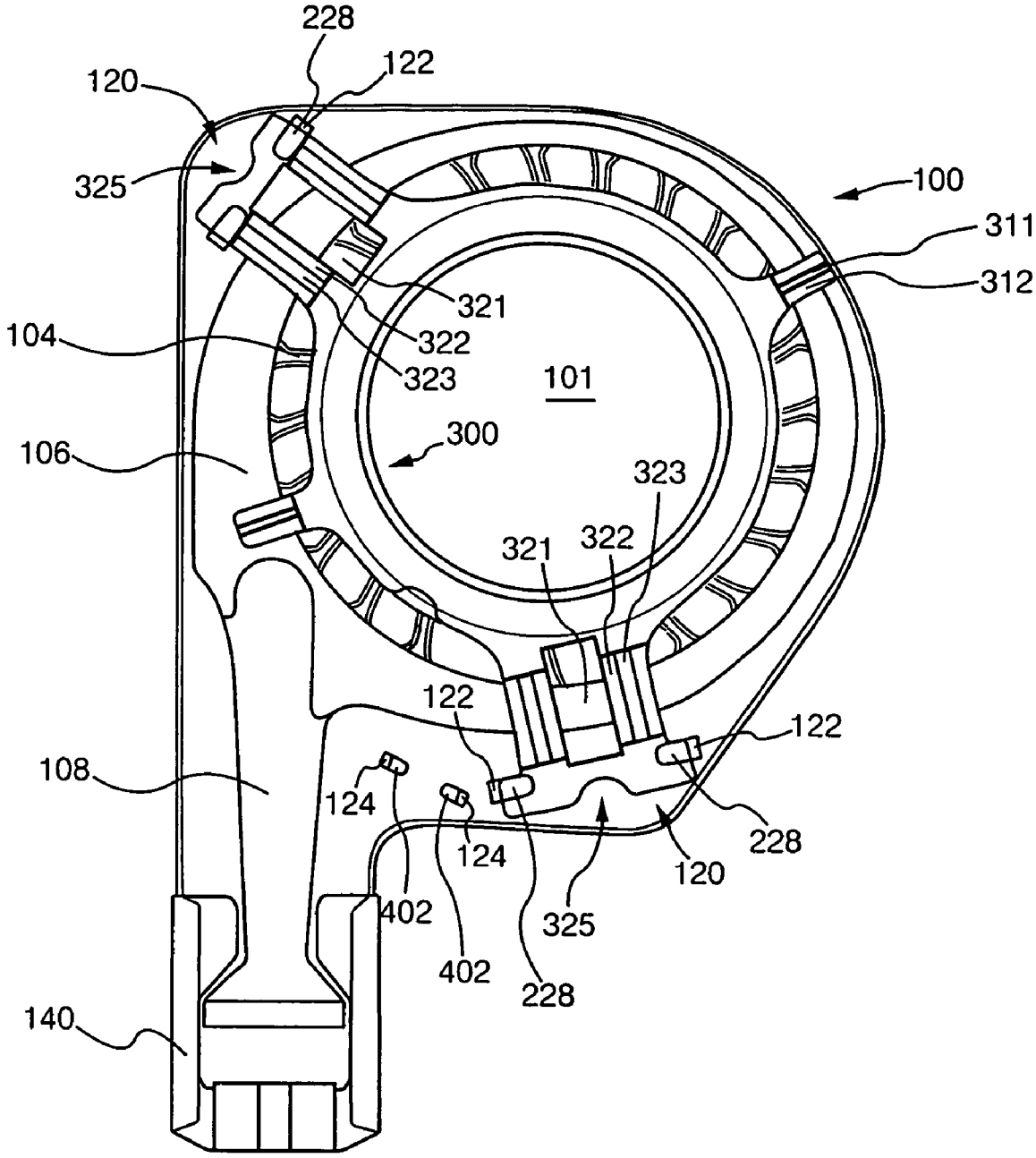
FIG. 3 is a bottom view of the burner according to the first preferred embodiment of the present invention.

The lower flow regulating plate 300 comprises, as shown in FIGS. 1 and 3, an annular portion 310, and substantially rectangular arms 320 extending from the outer circumference of the annular portion 310 respectively to the upper left area and lower area of FIG. 3 to reach the flange portion 120. The annular portion 310 mounts a dish (not shown) having a somewhat larger diameter than the inner diameter of the annular portion. The dish is for receiving the liquid or the like dropping from above and preventing the liquid or the like from dropping further downward.

At the center of each arm 320 is formed a cutout portion 321 disposed along the outer radial direction of the annular portion 310. Each arm 320 further comprises a lower step portion 322 created by downwardly deforming the portion separated into two parts via the cutout portion 321. The lower step portion 322 has ribs 323 raised upward and extending in the outer radial direction of the annular portion 310. Further, a recess 325 is formed to the tip of each arm 320.

Further, the lower flow regulating plate 300 comprises contact sections 312 disposed at two locations, the upper right area and the lower left area thereof as shown in FIG. 3, that extend downward once from the outer circumference of the truncated cone portion 310 and then toward the outer radial direction of the annular portion 310. Each contact section 312 has a rib 311 raised upward and extending in the outer radial direction of the annular portion 310.

The burner 100 further comprises a thermocouple mounting plate 400 having a pair of claw portions 402 protruding downward.

The method for fixing the upper flow regulating plate 200 and the lower flow regulating plate 300 to the burner 100 will now be described with reference to FIGS. 1 through 4.

At first, the claw portions 402 of the thermocouple mounting plate 400 are inserted to slits 124 provided to the flange portion 120 at the lower area of FIG. 2 (refer to FIGS. 1 and 2). By bending the claw portions 402 projecting below the flange portion 120 inwardly, the thermocouple mounting plate 400 is crimped to the flange portion 120 (refer to FIG. 3).

Moreover, the arms 320 of the lower flow regulating plate 300 are respectively positioned to come into contact with the flange portion 120 between each pair of slits 122 (refer to FIGS. 1 and 3). Further, the claw portions 228 on each arm 220 of the upper flow regulating plate 200 are inserted to the slits 122 provided to the flange portion 120 of the burner 100 (refer to FIGS. 1 and 2). The claw portions 228 projecting below the flange portion 120 are folded in so as to embrace each arm 320 of the lower flow regulating plate 300 (refer to FIGS. 3 and 4). Thus, the upper flow regulating plate 200 and the lower flow regulating plate 300 are crimped to the burner 100.

According to the burner of the first embodiment, the flange portion 120 is disposed integrally to the burner 100, so it will not increase the number of components. Further, the upper flow regulating plate 200 and the lower flow regulating plate 300 are fixed to the burner 100 via arms 220 and 320 formed integrally thereto. Accordingly, the number of components is reduced compared to the case where separate fixing members are used to fix the upper flow regulating plate 200 and the lower flow regulating plate 300 to the burner 100. Therefore, the management costs or the like of the upper flow regulating plate 200 and the lower flow regulating plate 300 can be cut down.

Figure 4:
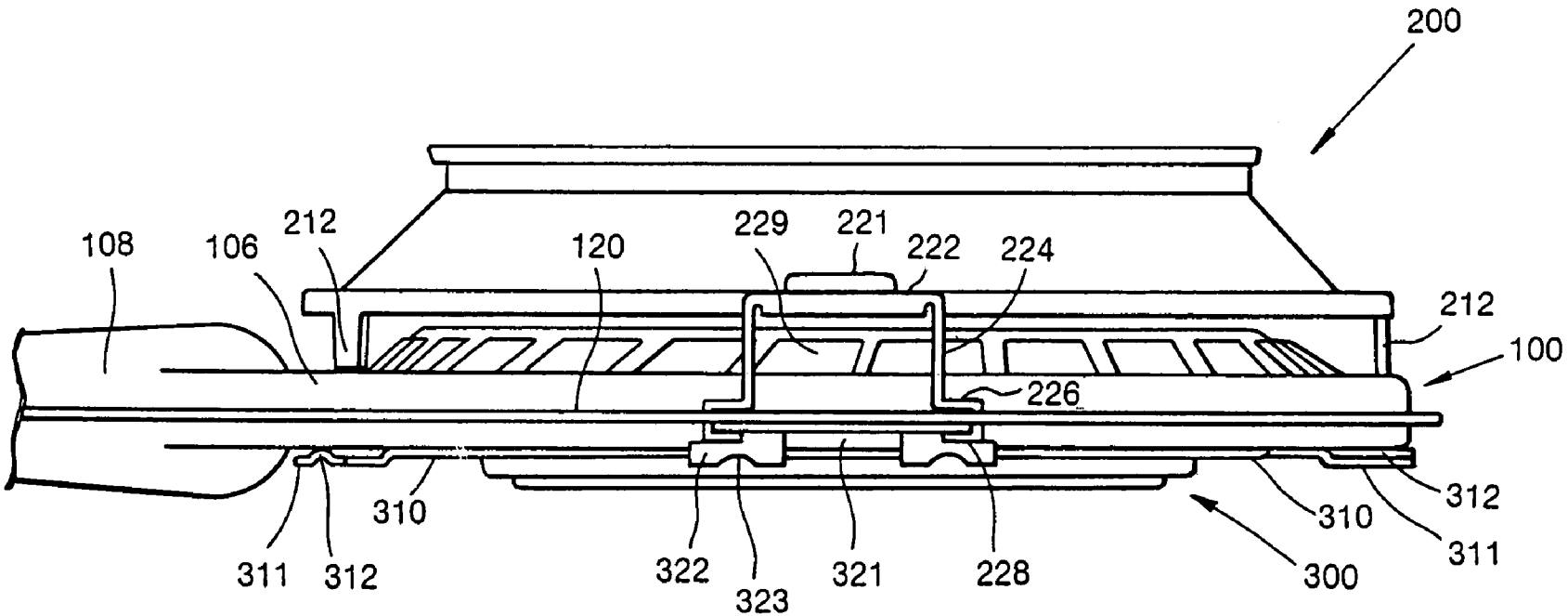
FIG. 4 is a side view showing the relevant portion of the burner according to the first preferred embodiment of the present invention.

Furthermore, the arms 220 and 320 are fixed via crimping to the flange portion 120 (refer to FIGS. 3 and 4). Therefore, when applying coating material to the upper flow regulating plate 200 and the lower flow regulating plate 300, there is no need to exclude the arms when immersing the plates in a bath containing coating material, and the entire body of the flow regulating plates 200 and 300 including the arms 220 and 320 can be immersed in coating material using existing facilities.

Moreover, since the upper flow regulating plate 200 and the lower flow regulating plate 300 are fixed to the burner 100 via crimping, the metal plate constituting the burner 100 can be coated with the coating material for facilitating processing, which was not possible when plates were fixed via spot welding. By applying a coating with the coating material for facilitating processing, the metal plate constituting the burner 100 can be press-molded smoothly without having to use oil, and the washing process to remove oil from the metal plate can be omitted.

According to the present invention, (1) the reduction of the number of components, (2) the easiness of applying coating material to upper and lower flow regulating plates and (3) the omission of oil washing process of the metal plate enable the upper flow regulating plate 200 and the lower flow regulating plate 300 to be fixed rationally to the burner 100 from the viewpoint of cost, and thus, the manufacture cost of the burner 100 can be reduced.

According further to the present embodiment, the arms 220 of the upper flow regulating plate 200 and the arms 320 of the lower flow regulating plate 300 are crimped to the same position of the flange portion 120 via claw portions 228. This structure enables the area of the flange portion 120 to be reduced and the burner 100 to be downsized compared to the case where the arms 220 of the upper flow regulating plate 200 and the arms 320 of the lower flow regulating plate 300 are crimped to different areas of the flange portion 120.

Furthermore, the arms 220 of the upper flow regulating plate 200 and the arms 320 of the lower flow regulating plate 300 are collectively crimped and fixed to the flange portion 120 via claw portions 228. This arrangement allows the upper flow regulating plate 200 and the lower flow regulating plate 300 to be fixed efficiently and promptly to the burner 100 compared to the case where the arms 220 of the upper flow regulating plate 200 and the arms 320 of the lower flow regulating plate 300 are crimped individually to the flange portion 120.

Moreover, the tilting of the upper flow regulating plate 200 and the lower flow regulating plate 300 when crimping the arms 220 of the upper flow regulating plate 200 and the lower flow regulating plate 300 to the burner 100 can be restricted by having contact sections 212 and 312 come into contact with the burner 100. Thus, it is possible to prevent the upper flow regulating plate 200 or the lower flow regulating plate 300 from being crimped to the burner 100 in a tilted state, which may cause inappropriate flow of secondary air and deteriorate the combustion of the burner 100 even slightly.

Each arm 220 of the upper flow regulating plate 200 has a passage 229 surrounded on three sides by the upper plate portion 222 and the side plate portions 224 (refer to FIG. 4). Further, each arm 320 of the lower flow regulating plate 300 has a cutout portion 321 formed thereto.

Therefore, secondary air can flow into the space formed between the burner 100 and the upper flow regulating plate 200 from the outside via the passage 229. Further, secondary air can flow into the space formed between the burner 100 and the lower flow regulating plate 300 from the outside via the cutout portion 321. Accordingly, even if the arms 220 and 320 take up a large width in the circumferential direction of the flow regulating plates 200 and 300 to ensure strength, the flow of secondary air toward flame ports 102 of the burner 100 can be prevented from being disturbed by the arms 220 and 320 and deteriorating the combustion state of the burner 100.

Figure 5:
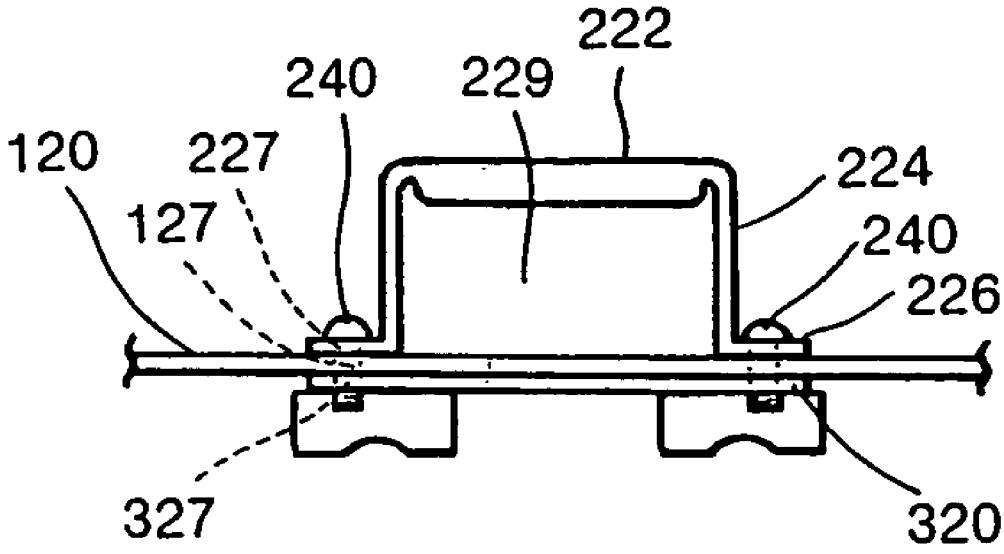
FIG. 5 is a side view showing the relevant portion of the burner according to a second preferred embodiment of the present invention.
Figure 6:
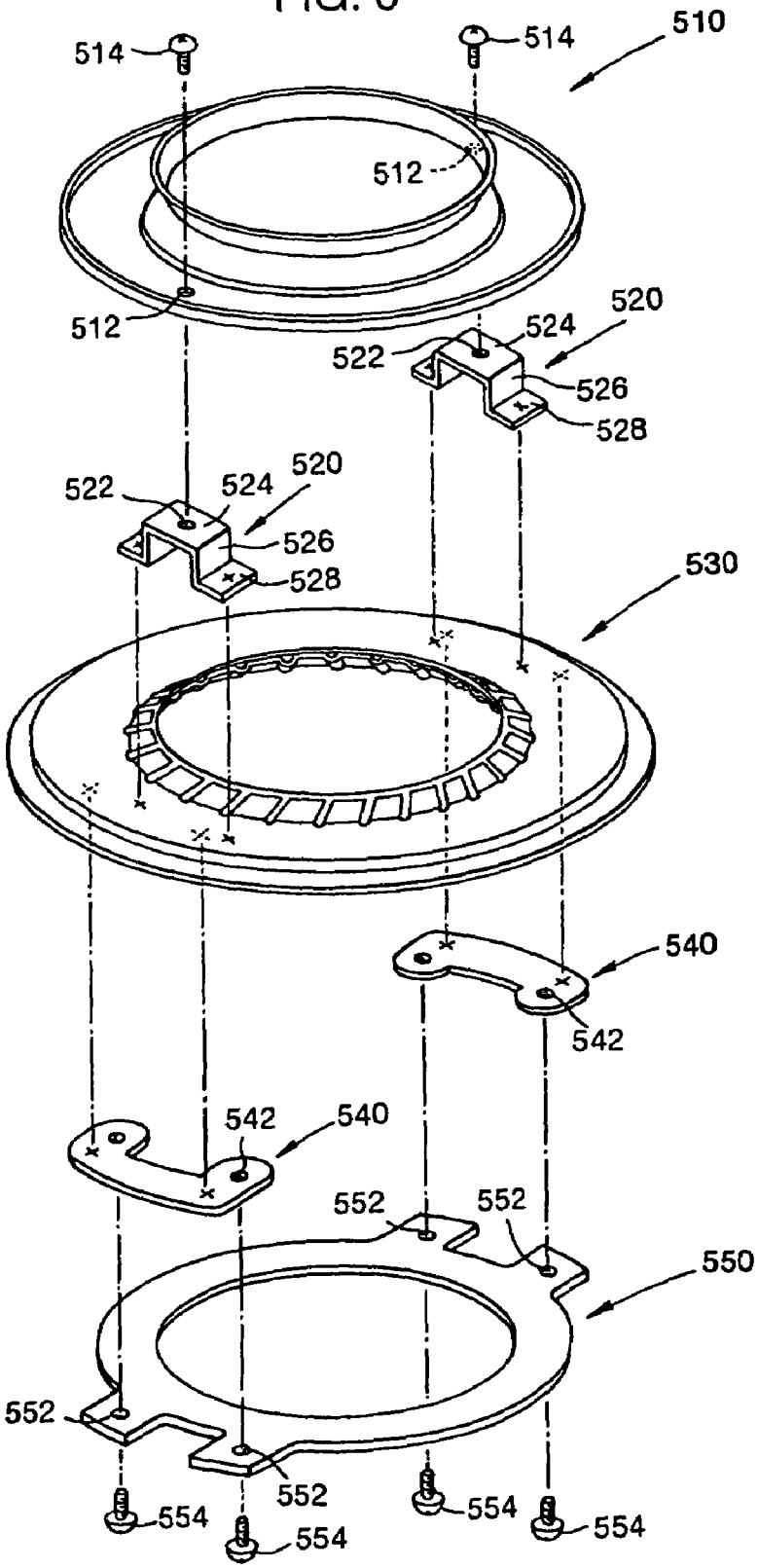
FIG. 6 is an explanatory view of a prior art burner.

Next, a burner according to a second embodiment of the invention will be described with reference to FIG. 5.

According to a burner 100 of the second embodiment, through holes 127 are provided instead of the slits 122 to each flange portion 120, and through holes (first screw holes) 227 are formed to the arms 220 of the upper flow regulating plate 200 omitting the claw portions 228, and a pair of screw holes (second screw holes) 327 is formed to the tip of each arm 320 of the lower flow regulating plate 300. The other constructions are the same as the burner of the first embodiment, so detailed descriptions thereof are omitted.

In the second embodiment, screws 240 passing through the through holes 227 on the arms 220 of the upper flow regulating plate 200 and the through holes 127 of each flange portion 120 are screwed onto the screw holes 327 on the arms 320 of the lower flow regulating plate 300. Thus, the upper flow regulating plate 200 and the lower flow regulating plate 300 are screwed onto the burner 100.

Similar to the burner of the first embodiment, the burner according to the second embodiment effectively reduces the manufacture costs.

The burner 100 according to the first and second embodiments is formed of two metal plates, but according to other embodiments, the burner can be formed of a single metal plate, or of three or more metal plates.

What is claimed is:

1. A burner comprising:

a metal plate with a round opening, having formed thereto a plurality of flame ports arranged along an inner circumference of the opening and an annular mixture pipe disposed outwardly of the opening for supplying a mixture of gas and primary air to the flame ports; and substantially annular upper and lower flow regulating plates respectively disposed above and below the metal plate with a clearance therebetween for regulating flow of secondary air;

a flange portion formed integrally thereto and projecting outwardly of the annular mixture pipe; and arms formed integrally to the upper and lower flow regulating plates, extending from outer circumferences of the upper and lower flow regulating plates across the annular mixture pipe to a position corresponding to the flange portion and fixed mechanically to the flange portion.

2. The burner according to claim 1, wherein the arms of the upper and lower flow regulating plates are mechanically fixed to the flange portion at the same position.

3. The burner according to claim 2, further comprising a fixing means for mechanically fixing the arms of both the upper and lower flow regulating plates together to the flange portion.

4. The burner according to claim 1, wherein contact sections are disposed along a circumferential direction of the flow regulating plates for restricting tilt of the flow regulating plates by coming into contact with the burner when the arms of the upper and lower flow regulating plates are mechanically fixed to the flange portion.

5. The burner according to claim 1, wherein the flange portion is provided with a slit;

the arm of the lower flow regulating plate is extended across the annular mixture pipe to reach the slit on the flange portion; and the arm of the upper flow regulating plate comprises an upper plate portion extending in the outer radial direction from the substantially annular upper flow regulating plate, a side plate portion extending downward from both left and right ends of the upper plate portion, a lower plate portion extending transversely from the lower end of the side plate portion in contact with the flange portion, and a claw portion extending from the end of the lower plate portion through the slit and protruding below the flange portion, which is bent to embrace the arm of the lower flow regulating plate and to be crimped to the flange portion.

6. The burner according to claim 1, wherein the flange portion is provided with a through hole;

the arm of the upper flow regulating plate comprises an upper plate portion extending in the outer radial direction from the substantially annular upper flow regulating plate, a side plate portion extending downward from both left and right ends of the upper plate portion, and a lower plate portion extending transversely from the lower end of the side plate portion in contact with the flange portion and having formed thereto a first screw hole corresponding to the through hole of the flange portion;

the arm of the lower flow regulating plate comprises a second screw hole corresponding to the through hole of the flange portion; and the arm of the upper flow regulating plate, the flange portion and the lower flow regulating plate are screwed together via the first screw hole, the through hole and the second screw hole.

7. The burner according to claim 2, wherein contact sections are disposed along a circumferential direction of the flow regulating plates for restricting tilt of the flow regulating plates by coming into contact with the burner when the arms of the upper and lower flow regulating plates are mechanically fixed to the flange portion.

8. The burner according to claim 3, wherein contact sections are disposed along a circumferential direction of the flow regulating plates for restricting tilt of the flow regulating plates by coming into contact with the burner when the arms of the upper and lower flow regulating plates are mechanically fixed to the flange portion.

9. The burner according to claim 2, wherein the flange portion is provided with a slit;

the arm of the lower flow regulating plate is extended across the annular mixture pipe to reach the slit on the flange portion; and the arm of the upper flow regulating plate comprises an upper plate portion extending in the outer radial direction from the substantially annular upper flow regulating plate, a side plate portion extending downward from both left and right ends of the upper plate portion, a lower plate portion extending transversely from the lower end of the side plate portion in contact with the flange portion, and a claw portion extending from the end of the lower plate portion through the slit and protruding below the flange portion, which is bent to embrace the arm of the lower flow regulating plate and to be crimped to the flange portion.

10. The burner according to claim 3, wherein the flange portion is provided with a slit;

the arm of the lower flow regulating plate is extended across the annular mixture pipe to reach the slit on the flange portion; and the arm of the upper flow regulating plate comprises an upper plate portion extending in the outer radial direction from the substantially annular upper flow regulating plate, a side plate portion extending downward from both left and right ends of the upper plate portion, a lower plate portion extending transversely from the lower end of the side plate portion in contact with the flange portion, and a claw portion extending from the end of the lower plate portion through the slit and protruding below the flange portion, which is bent to embrace the arm of the lower flow regulating plate and to be crimped to the flange portion.

11. The burner according to claim 2, wherein the flange portion is provided with a through hole;

the arm of the upper flow regulating plate comprises an upper plate portion extending in the outer radial direction from the substantially annular upper flow regulating plate, a side plate portion extending downward from both left and right ends of the upper plate portion, and a lower plate portion extending transversely from the lower end of the side plate portion in contact with the flange portion and having formed thereto a first screw hole corresponding to the through hole of the flange portion;

the arm of the lower flow regulating plate comprises a second screw hole corresponding to the through hole of the flange portion; and the arm of the upper flow regulating plate, the flange portion and the lower flow regulating plate are screwed together via the first screw hole, the through hole and the second screw hole.

12. The burner according claim 3, wherein the flange portion is provided with a through hole;

the arm of the upper flow regulating plate comprises an upper plate portion extending in the outer radial direction from the substantially annular upper flow regulating plate, a side plate portion extending downward from both left and right ends of the upper plate portion, and a lower plate portion extending transversely from the lower end of the side plate portion in contact with the flange portion and having formed thereto a first screw hole corresponding to the through hole of the flange portion;

the arm of the lower flow regulating plate comprises a second screw hole corresponding to the through hole of the flange portion; and the arm of the upper flow regulating plate, the flange portion and the lower flow regulating plate are screwed together via the first screw hole, the through hole and the second screw hole.

* * * * *